US010576387B2

(12) United States Patent
Pondorfer

(10) Patent No.: US 10,576,387 B2
(45) Date of Patent: Mar. 3, 2020

(54) AMUSEMENT RIDES

(71) Applicant: Walter Pondorfer, Tirol (AT)

(72) Inventor: Walter Pondorfer, Tirol (AT)

( * ) Notice: Subject to any disclaimer, the term of this patent is extended or adjusted under 35 U.S.C. 154(b) by 0 days.

(21) Appl. No.: 15/571,443

(22) PCT Filed: May 4, 2016

(86) PCT No.: PCT/EP2016/060105
§ 371 (c)(1),
(2) Date: Nov. 2, 2017

(87) PCT Pub. No.: WO2016/177841
PCT Pub. Date: Nov. 10, 2016

(65) Prior Publication Data

US 2018/0133605 A1 May 17, 2018

(30) Foreign Application Priority Data

May 4, 2015 (GB) ..... 1507618.5

(51) Int. Cl.
*A63G 27/02* (2006.01)
*A63G 9/08* (2006.01)
(Continued)

(52) U.S. Cl.
CPC ..... *A63G 27/02* (2013.01); *A63G 9/08* (2013.01); *A63G 29/02* (2013.01); *A63G 1/28* (2013.01); *A63G 1/30* (2013.01)

(58) Field of Classification Search
CPC ... A63G 1/00; A63G 1/34; A63G 7/00; A63G 27/00; A63G 27/02; A63G 27/04;
(Continued)

(56) References Cited

U.S. PATENT DOCUMENTS 923,489 A 6/1909 Chance
1,279,911 A 9/1918 Ridgway
(Continued)

FOREIGN PATENT DOCUMENTS

CN 2603681 2/2004
CN 202398100 U 8/2012
(Continued)

OTHER PUBLICATIONS

International Search Report dated Aug. 11, 2016 for PCT/EP2016/060105.

*Primary Examiner* — Kien T Nguyen
(74) *Attorney, Agent, or Firm* — Christopher M. Ramsey; GrayRobinson, P.A.

(57) ABSTRACT

A gondola 40 is mounted to move freely along an endless, sinuous track 20. With the track 20 rotating about a horizontal axis, the gondola 40 is raised and, as the track 20 presents a downhill section, the gondola 40 rolls down it under the influence of gravity. The steeper the downhill section, the greater the speed until the gondola 40 reaches its lowermost position (FIG. 1B). Its momentum cause the gondola 40 to carry on travelling along a momentarily uphill section of the track 20. Travel from then on depends on a number of variables, including the rotational speed, direction and acceleration of the track 20, the weight of the gondola 40 and its passengers, the natural damping effect of friction in the mounting of the gondola 40 on the track 20, and any additional braking and/or driving effect that may be applied to the gondola 40. As compared to a conventional rollercoaster, the ride 1 may occupy a very much smaller footprint, incur a much lower capital cost and be readily adaptable to mobile use. By varying the operating parameters, many differing ride experiences may be achieved.

58 Claims, 5 Drawing Sheets

(51) Int. Cl.
*A63G 29/02* (2006.01)
*A63G 1/28* (2006.01)
*A63G 1/30* (2006.01)

(58) Field of Classification Search
CPC ..... A63G 29/00; A63G 29/02; A63G 9/00; A63G 9/08
USPC ..... 472/28–35, 44–47
See application file for complete search history.

(56) References Cited

U.S. PATENT DOCUMENTS

| | | | | |
|---|---|---|---|---|
| 1,354,436 | A | 9/1920 | Hermann | |
| 1,546,375 | A | 7/1925 | Geiser | |
| 1,564,952 | A * | 12/1925 | Fisher | A63G 1/34 104/77 |
| 1,568,424 | A | 1/1926 | Smith | |
| 1,577,689 | A | 3/1926 | Capitelli | |
| 1,730,265 | A | 10/1929 | Bulmer | |
| 1,738,355 | A | 12/1929 | Cappabianco | |
| 1,877,256 | A | 9/1932 | Siebert | |
| 2,274,956 | A | 3/1942 | Eyerly | |
| 2,458,150 | A | 1/1949 | D'Errico | |
| 2,806,697 | A | 9/1957 | Huhn et al. | |
| 3,451,673 | A | 6/1969 | Matson | |
| 3,631,805 | A | 1/1972 | Schwarzkopf | |
| 4,410,173 | A | 10/1983 | Bohme | |
| 4,971,314 | A | 11/1990 | Barber | |
| 5,688,178 | A | 11/1997 | Emrie | |
| 6,994,629 | B2 * | 2/2006 | Bussink | A63G 27/02 472/44 |
| 7,610,859 | B1 | 11/2009 | Dietrich | |
| 8,066,576 | B2 * | 11/2011 | Threlkel | A63G 7/00 104/53 |
| 2002/0042303 | A1 | 4/2002 | Larson et al. | |
| 2008/0113822 | A1 | 5/2008 | Kitchen et al. | |
| 2010/0326312 | A1 | 12/2010 | Jacobi et al. | |
| 2012/0172139 | A1 | 7/2012 | Nemeth et al. | |
| 2014/0174314 | A1 | 6/2014 | Schmidt | |

FOREIGN PATENT DOCUMENTS

| | | | |
|---|---|---|---|
| DE | 819057 | | 10/1951 |
| DE | 202012104141 | U1 | 2/2014 |
| EP | 1593415 | B1 | 8/2011 |
| EP | 1364691 | B1 | 9/2013 |
| GB | 190927429 | A | 3/1910 |
| GB | 453396 | A | 9/1936 |
| GB | 466855 | A | 6/1937 |
| WO | 9523636 | A2 | 9/1995 |
| WO | 2012040647 | A3 | 3/2012 |

* cited by examiner

AMUSEMENT RIDES

CROSS-REFERENCE TO RELATED APPLICATIONS

This is the U.S. National Stage entry of International Application No. PCT/EP2016/060105, filed May 4, 2016, which claims priority to GB Application No. 1507618.5, filed May 4, 2015. These prior applications are incorporated by reference in their entirety.

FIELD

The present invention relates to amusement rides.

BACKGROUND

Amusement rides have been popular for generations. They range from small and gentle rides for children and families to large and thrilling rides for all. These days, many riders want more and more excitement. Most rides are variations of established principles, but the different variations can provide different and surprising thrills that riders enjoy. Accordingly, there is a perpetual quest for new rides and variations of rides.

BRIEF SUMMARY

Preferred embodiments of the present invention aim to provide amusement rides that can fulfil this need.

Rides of the "roller coaster" type enjoy much popularity. However, they are generally very expensive to construct, require a large footprint and, consequently, are not well-suited as mobile rides that can be moved readily from one fairground site to another, as with travelling fairs.

Preferred embodiments of the present invention aim to provide amusement rides that may be improved in these respects.

According to one aspect of the present invention, there is provided an amusement ride comprising a support; a track that is mounted on the support and describes a path of travel of a carriage, the path having a vertical component of direction; and a carriage mounted on the track for travel along the track: wherein the track is mounted on the support for rotational movement about an axis to cause relative movement between the carriage and the track, at least partly under the force of gravity.

In the context of this specification, the term "carriage" includes any suitable vehicle or apparatus for the transport of one or more passenger; and the term "track" includes any suitable elongate member or structure with which a carriage co-operates to guide the carriage along the track for respective movement therebetween.

Preferably, the track is an endless track.

Preferably, said path is of sinuous form.

Preferably, said path is substantially upright.

Preferably, said axis is substantially horizontal.

An amusement ride as above may further comprise a powered adjusting device for adjusting the angle of said axis to the horizontal and thus the angle of said path to the vertical.

The carriage may be provided with a brake to cause braking of the travel of the carriage with respect to the track.

The track may be provided with a brake to cause braking of the travel of the carriage with respect to the track.

The carriage may be provided with a drive device to cause acceleration of the travel of the carriage with respect to the track.

The track may be provided with a drive device to cause acceleration of the travel of the carriage with respect to the track. Preferably, said path is a fixed path.

An amusement ride as above may further comprise a prime mover arranged to impart said rotational movement to the track.

An amusement ride as above may further comprise a controller arranged to control said rotational movement of the track.

Said controller may be arranged to control acceleration and/or deceleration of the carriage with respect to the track.

Said controller may be arranged to control the angle of said axis to the horizontal and thus the angle of said path to the vertical.

Preferably, the track has inner and outer surfaces that run substantially parallel to one another.

Preferably, the carriage is mounted on or disposed at an outer surface of the track.

Preferably, the radius of the track, measured as the distance from the track to the axis of rotation, varies along the length of the track.

Preferably, the maximum radius of the track is at least 2, 3 or 4 times the minimum radius of the track.

Preferably, the overall length of the track is at least 20, 30, 40, 50, 80, 100 or 200 times the length of the carriage.

Preferably, the track has changes in gradient that are smooth.

Preferably, the track has changes in gradient that are gradual, relative to the length of the carriage.

Preferably, in use, the carriage travels upwardly to at least the level of the axis of rotation. Preferably, in use, the carriage travels upwardly above the axis of rotation.

Preferably, in use, the carriage travels upwardly to the top of the track.

Preferably, in use, the carriage travels upwardly to the top of the track and over the top of the track. Preferably, in use, the direction of rotation of the track is reversed.

An amusement ride as above may comprise a plurality of said carriages mounted on the track.

The invention extends to a method of operating an amusement ride according to any of the preceding aspects of the invention, including the steps of mounting the carriage on the track for travel along the track; and rotating the track about said axis to cause relative movement between the carriage and the track, at least partly under the force of gravity.

BRIEF DESCRIPTION OF THE DRAWINGS

For a better understanding of the invention, and to show how embodiments of the same may be carried into effect, reference will now be made, by way of example, to the accompanying diagrammatic drawings, in which.

In the figures, like references denote like or corresponding parts.

DETAILED DESCRIPTION OF EXAMPLE EMBODIMENTS

Figure 1A:
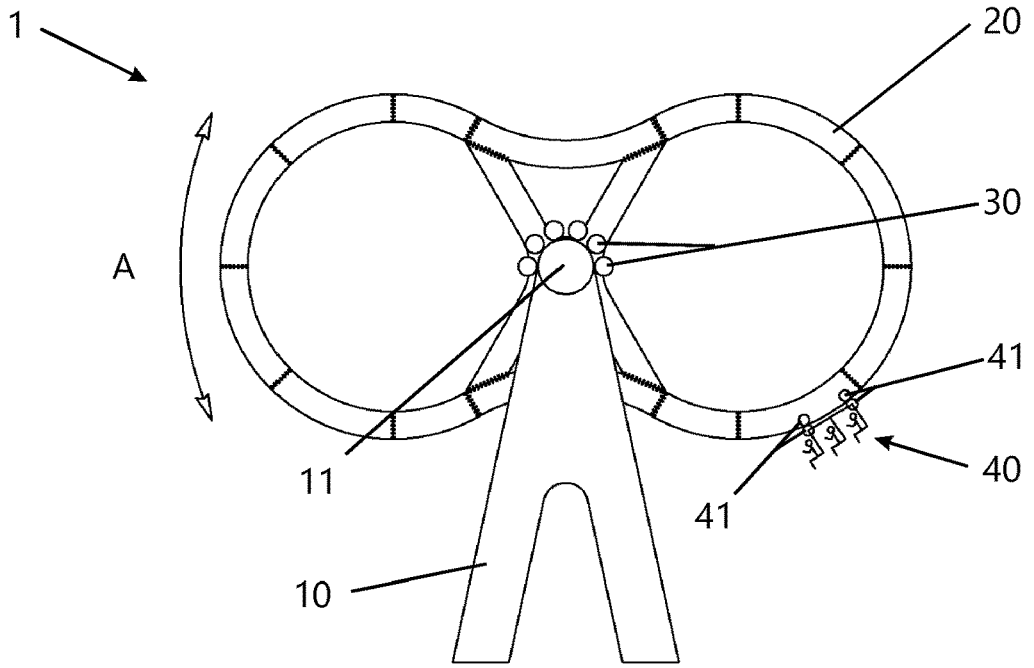
FIG. 1A shows one example of an amusement ride in side elevation, with the ride in a first position.

It is to be understood that the various features that are described in the following and/or illustrated in the drawings are preferred but not essential. Combinations of features described and/or illustrated are not considered to be the only possible combinations. Unless stated to the contrary, individual features may be omitted, varied or combined in different combinations, where practical.

The amusement ride 1 that is shown in FIGS. 1 and 2 comprises a support 10 that is secured to the ground 2 at its base and carries a bearing 11 at its upper end. The lower end of the support 10 is bifurcated to provide two legs that are secured to the ground 2.

A curved track 20 is mounted on the bearing 11 for rotation about an axis 12, as indicated by arrow A. In this example, the axis 12 is substantially horizontal. A plurality of prime movers that, in this example, comprise electric or hydraulic motors 30, are mounted around the bearing 11 and are arranged to transmit drive to the track 20 in order to rotate it about the axis 12. The drive may be transmitted by gear wheels, gear boxes, friction wheels, chains, belt or any other suitable transmission. The bearing 11 may be formed as a big gear box.

A carriage in the form of a gondola 40 is mounted on the track 20 by means of wheels or rollers 41 that engage the track 20, such that the track 20 affords a support surface for the gondola 40. The gondola 40 has seats 42 in which riders 43 are securely seated. Although the gondola 40 may be provided with optional braking and/or drive means, as will be described further below, its default mounting arrangement is such that the gondola 40 can move freely along the track 20—particularly under the influence of the force of gravity. As may be seen in FIGS. 1 and 2, the track 20 is long relative to the length of the gondola 40.

As may be seen in FIGS. 1 and 2, the track 20 describes a path of travel of the gondola 40, which path is upright—in this example, substantially vertical. The track 20 is, in this example, an endless track and the path is of sinuous form, generally in the shape of a FIG. 8.

It may be appreciated that, with no braking or driving effect applied to the gondola 40, and with the track 20 rotating about the axis 12 under the influence of the drive motors 30, the gondola 40 will tend to be raised with the track 20 and, as the path of the track 20 presents a downhill section, the gondola 40 will roll down that section under the influence of gravity. The steeper the downhill section, the faster the gondola 40 will travel as it falls under gravity.

Figure 1B:
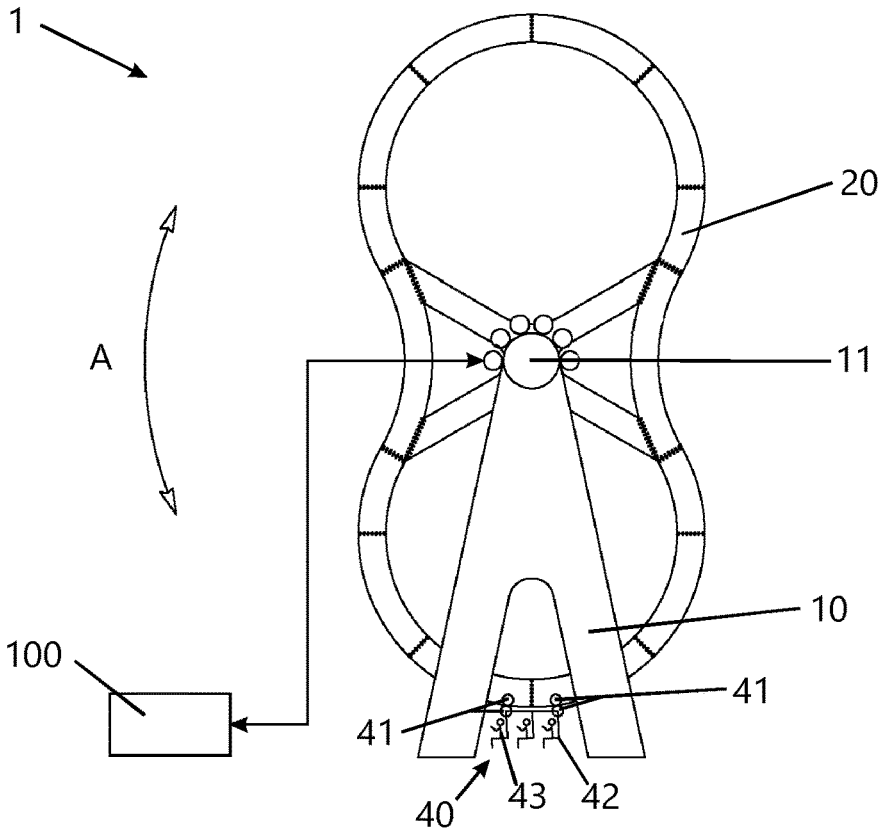
FIG. 1B is a view similar to FIG. 1A, but showing the ride in a second position.

For example, in the position illustrated in FIG. 1A, the gondola 40 has been raised from a lowermost position (at which riders can enter and exit the gondola 40), and is seen rolling down a relatively gentle downhill section of the track 20 at a potentially modest speed. With the track 20 rotating counterclockwise (as seen) into the position illustrated in FIG. 1B, the gondola 40 will run down a much steeper downhill section of the track 20 at potentially great speed until it reaches its lowermost position as shown in FIG. 1B. Of course, in such a dynamic situation, the gondola 40 will not come to an abrupt stop at its lowermost position, but its momentum will cause it to carry on travelling along what is then momentarily an uphill section of the track 20.

What happens to the travel of the gondola 40 from then on will depend on a number of variables, including the rotational speed, direction and acceleration of the track 20, the weight of the gondola 40 and its passengers, the natural damping effect of friction in the rolling mounting of the gondola 40 on the track 20—and any additional braking and/or driving effect that may be applied to the gondola 40.

By careful selection of the speed of rotation of the track 20, the gondola 40 may be caused to travel mostly in a forward direction, but at different attitudes (inclinations) and at different speeds. Alternatively, the gondola 40 may travel backwards at times—for shorter or longer periods as determined largely by the rotation of the track 20, the direction of which, as indicated above, may be periodically reversed.

It may be appreciated that the ride sensation may be very similar to that experienced on a conventional rollercoaster, with sudden changes in speed, acceleration and attitude of the gondola 40—and, in this case, changes of direction from forward to reverse. Indeed, taking the momentum of the gondola 40 into account, the gondola 40 may travel up to the level of the axis 12 of rotation, above that level and even up to the top of the track 20 and over it to the other side, where it will accelerate downwardly under the influence of gravity.

However, as compared to a conventional rollercoaster, the illustrated ride 1 may occupy a very much smaller footprint, incur a much lower capital cost and be readily adaptable to mobile use. Moreover, by varying the operating parameters of the ride, differing ride experiences may be achieved.

By way of example, the support 10 may have an overall height of around 50 m and the track 20 may have a length of about 60 m and a width of about 30 m. This may gave an overall track length of around 190 m. If the length of the gondola 40 is 2 m, then the length of the track 20 will be around 95 times the length of the gondola 40. Depending upon the configurations of the track 20 and gondola 40, the overall length of the track may be at least 20, 30, 40, 50, 80, 100 or 200 times the length of the gondola 40.

A controller 100 enables an operator to control the speed and direction of rotation of the track 20. Alternatively or additionally, the controller 100 may store a number of predetermined sequences by which speed and direction of rotation of the track may be varied automatically. The controller 100 may also control other operational parameters of the ride 1, including inclination of the axis 12 and positive braking and drive of the gondola 40, as described below.

Figure 2A:
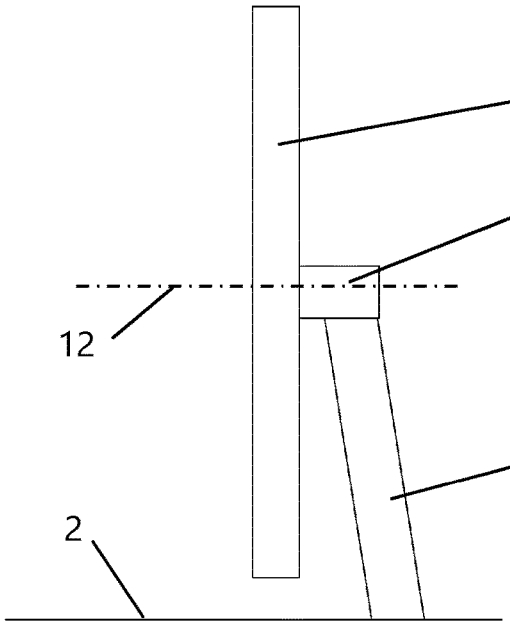
FIG. 2A shows the ride of FIGS. 1A and 1B in end elevation, with a first form of support.
Figure 2B:
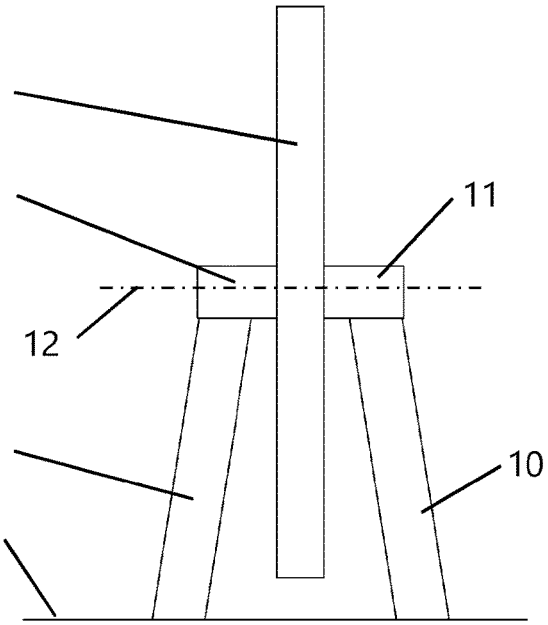
FIG. 2B is a view similar to FIG. 2A, but showing a second form of support.

FIG. 2A shows a single support 10 and bearing 11 upon which the track 20 is mounted. FIG. 2B shows the track 20 supported between two supports 10, each carrying a respective bearing 11.

Figure 3:
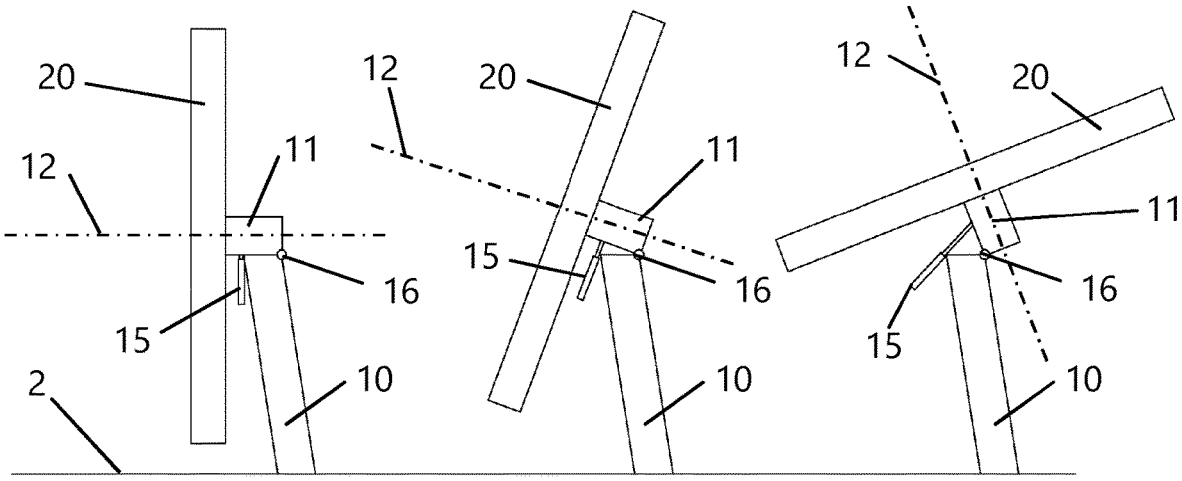
FIG. 3 is a view similar to FIG. 2 A, with an adjusting device for adjusting an angle of inclination of a track of the ride, the figure showing three different angles of inclination.

In FIG. 3, the arrangement of FIG. 2A is modified such that the bearing 11 is mounted for pivotal movement about a pivot 16, under the influence of one or more hydraulic ram 15 (or alternative adjustment device). This enables the axis of rotation 12 of the track 20 to be varied from the substantially horizontal position as shown at the left of FIG. 3 to a gently inclined angle as shown in the middle of FIG. 3 and to a more steeply inclined angle as shown at the right of FIG. 3.

The effect of varying the angle of the axis of rotation 12 whilst the ride is in operation is to move the gondola 40 laterally as it travels along the track 20 and therefore add a further dimension to the ride experience. Variation of the angle of the axis of rotation 12 may be effected via controller 100, which also controls the speed and direction of rotation of the track 20.

Figure 4:
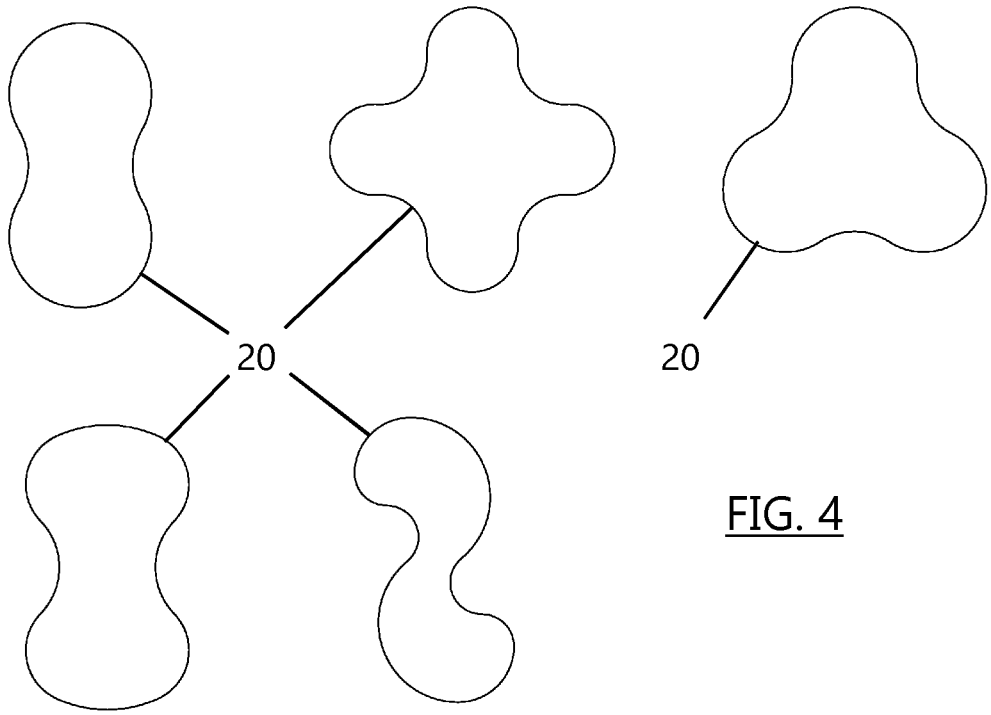
FIG. 4 illustrates different topologies of tracks for use in a ride as shown in the preceding figures.

Instead of the path of the track 20 being substantially upright in its default position, with a substantially horizontal axis of rotation, it may be permanently inclined to the vertical—for example, at an angle of up to 45°. Alternatively, such an angle of inclination may be the default position of the track 20, with an adjustment device to adjust the angle of inclination in use, along the lines described with reference to FIG. 3. FIG. 4 illustrates different topologies for the track 20, to afford different paths of travel of the gondola 40. Each of the topologies affords a closed, sinuous path.

Figure 8:
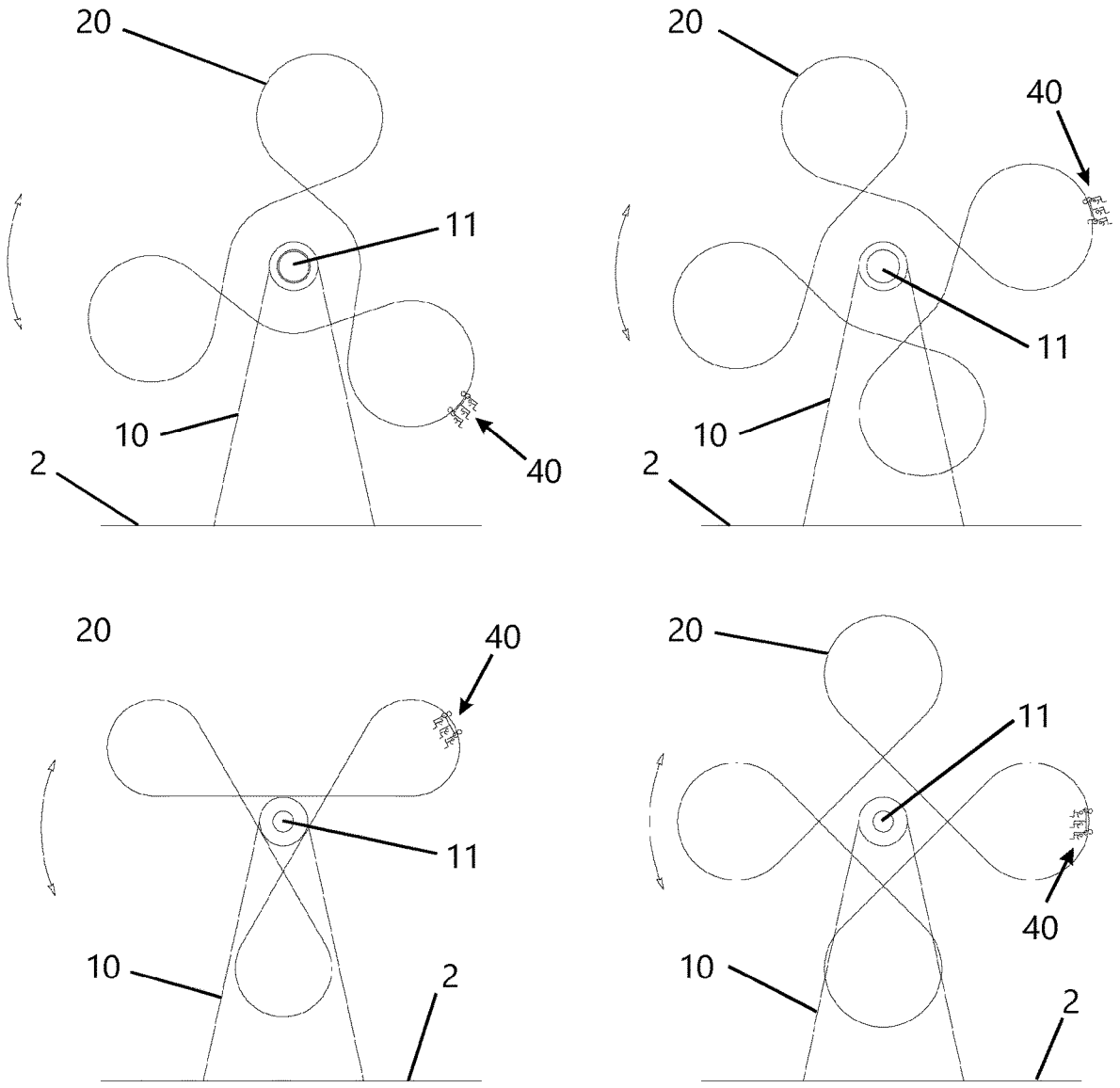
FIG. 8 illustrates further different topologies of tracks.

FIG. 8 illustrates further different topologies for the track 20, to afford different paths of travel of the gondola 40. Each of the topologies affords a closed, sinuous path but, in these examples, sections of the track 20 cross one another. Therefore, all of the track 20 does not lie in one plane but has sections mutually displaced so that they cross behind and in front of one another. The gondolas 40 may travel on either the outside or the inside of the track 20. As may be seen in FIG. 8, the paths of travel of the gondolas 40 extend above the bearing 11 that defines the axis 12 of rotation of the track 20.

In another example, a track such as 20 may include a section in the form of a helix or 'corkscrew', as known in conventional roller coasters, where a gondola is rotated about its axis of travel along the track, with the riders being inverted during such rotation.

Figure 5:
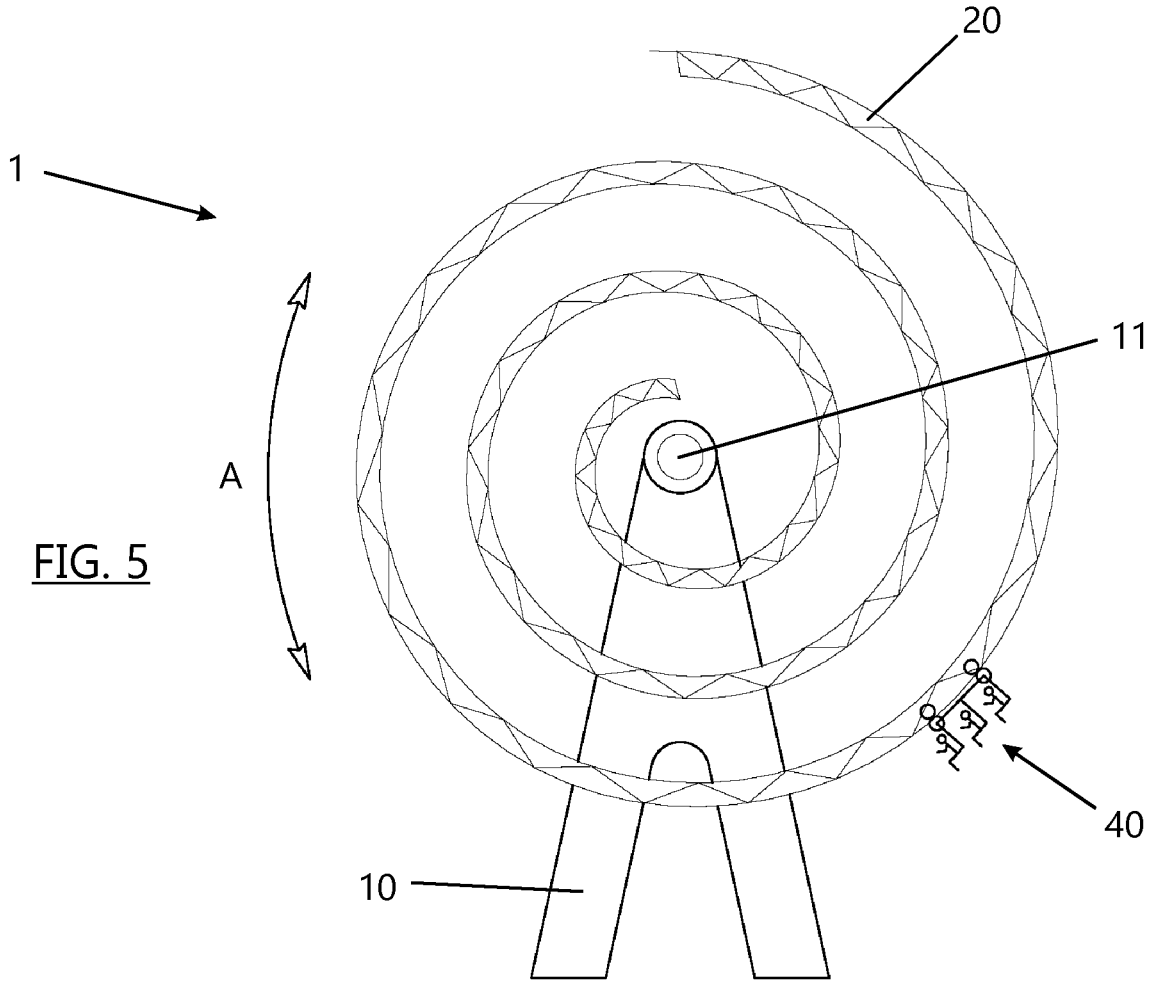
FIG. 5 is a view similar to FIG. 1 A, wherein the ride has a spiral track.

FIG. 5 shows a track 20 that describes a spiral or helical path of travel for the gondola 40. As the gondola 40 moves along the track 20, it experiences tighter and tighter curves. In this example, the gondola 40 may travel from one end of the spiral to the other and then reverse. If the spiral has the form of a Fermat's spiral or similar, the gondola may move firstly radially inwards and then radially outwards without changing direction. That is, instead of the inner part of the (first) spiral coming to an end, it may loop through 180° and then continue outwardly through a second spiral, interleaved with the first spiral. Likewise, the outer ends of first and second interleaved spirals may be interconnected by a loop through 180°. In another arrangement, the inner end of the spiral as shown in FIG. 5 may be joined to the outer end of the spiral by means of a further section of track that passes in front of or behind the illustrated track sections. As with all embodiments, rotational movement of the track 20 may be varied continuously in both speed and direction, to vary the ride experience for riders on the gondola 40.

In all of FIGS. 1, 4, 5 and 8, the radius of the track 20, measured as the distance from the track 20 to the axis of rotation 12, varies along the length of the track 20. Preferably, the maximum radius of the track is at least 2, 3 or 4 times the minimum radius of the track.

Figure 6A:
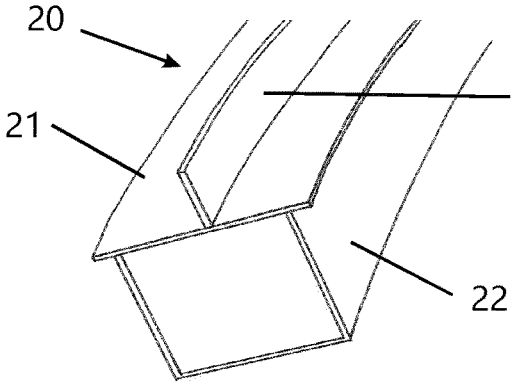
FIG. 6A is a perspective view of part of a track of box-form configuration.

FIG. 6A illustrates a section of track 20 of box-form configuration. An upper rail 21 is provided at the top of a box section 22 to support wheels or rollers of the gondola 40 whilst a central rail 23 cooperates with a braking and/or drive system on the gondola 40 to afford positive braking and/or acceleration, in addition to that experienced under the influence of gravity as a result of rotation of the track 20.

Figure 6B:
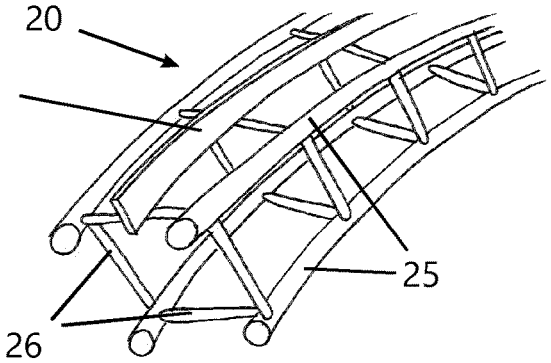
FIG. 6B is a view similar to FIG. 6A but showing part of a track of space-frame configuration.

FIG. 6B is a view similar to FIG. 6A but showing a section of track 20 of space-frame configuration. That is, the track 20 comprises four elongate rails 25 interconnected by cross-members 25. As in FIG. 6 A, a central rail 23 cooperates with a braking and/or drive system on the gondola 40.

In both FIGS. 6A and 6B, the track 20 has inner and outer surfaces that run substantially parallel to one another. The gondola 40 is mounted on or disposed at an outer surface of the track 20. In many configurations, this gives a longer track surface than the inner surface of the track.

Figure 7:
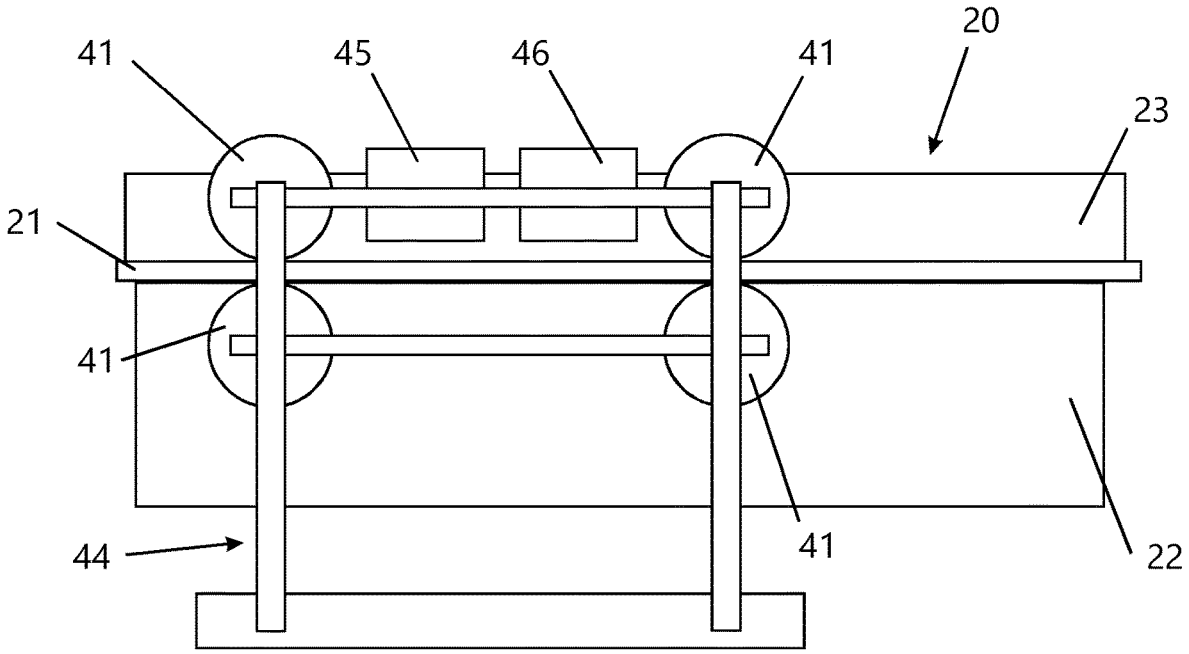
FIG. 7 is a diagrammatic side elevation of a section of track upon which a gondola is engaged.

FIG. 7 illustrates diagrammatically a section of track 20 similar to that of FIG. 6A. Rollers 41 are mounted on a support frame 44 for a gondola 40. The rollers 41 engage upper and lower faces of the rail 21, as seen in the figure. An optional braking device 45 co-operates with the central rail 23 to provide controlled braking of the gondola 40. For example, the central rail 23 and/or braking device 45 may generate electromagnetic fields, e.g. by way of permanent magnets and/or electromagnetic devices, which interact to cause braking.

Likewise, an optional drive device 46 may co-operate with the central rail 23 to provide controlled positive drive of the gondola 40. Again, the central rail 23 and/or drive device 45 may generate electromagnetic fields, e.g. by way of permanent magnets and/or electromagnetic devices, which interact to cause relative movement between the gondola 40 and the track 20. Alternatively or additionally, the braking and/or drive devices 45, 46 may provide direct braking or drive to the rollers 41, or interact with the track 20 in alternative ways. As various ways of providing braking and drive to carriages on tracks of amusement rides are known, including linear motors and brakes, further explanation will not be given here. Control of the optional braking and positive drive may be effected via controller 100, which also controls the speed and direction of rotation of the track 20.

Communication between the controller 100 and motors 30, actuator 15, braking device 45 and drive device 46 may be by direct connections where possible, and by commutator or wireless connections for moving parts.

It will be noted that, as movement of the gondola 40 on the track 20 is principally under the effect of gravity, the gondola will naturally run down to a low position on the track 20, with riders in an upright position, in the event of a power failure and the track 20 ceasing to rotate. The configuration and mounting of the track 20 may be such that, in the event of a power failure, the track 20 slowly rotates under the effect of gravity into a default position with the gondola 40 in a lowermost position where riders can exit the gondola—for example, as shown in FIG. 1B. Thus, the ride 1 may readily provide failsafe modes of operation.

It will be noted that, in the illustrated examples, the track 20 has changes in gradient that are smooth and gradual, relative to the length of the gondola 40. Although the illustrated embodiments show riders 43 in seats 42, alternative means of supporting the riders 43—for example, suspension harnesses—may be provided. A gondola such as 40 may be mounted above a track such as 20, rather than suspended from it. A plurality of gondolas or other carriages may be provided. Typically, a plurality of carriages would be connected in series, as a train, so that they all moved in unison.

The illustrate embodiments show tracks 20 that are disposed generally in a vertical plane, in order to take full advantage of gravitational forces that act on the gondolas 40 to cause relative motion between the gondolas 40 and the track 20. However, it is not essential for the tracks 20 to be in a vertical plane—as illustrated in FIG. 3, where the axis of rotation 12 may be adjusted. The paths of travel described by the tracks should be sufficiently upright—or have sufficient upright sections—to allow gravitational forces to act on the gondolas 40 to cause relative motion between the gondolas 40 and the track 20. Thus, in the context of this specification, the term "upright" includes both vertical and having a significant vertical component of direction—e.g. at an angle of 45, 60 or 80 degrees to the horizontal. It will be appreciated that, depending upon the respective motions of a track 20 and a gondola 40 at any given time, relative movement between the gondola 40 and the track 20 may comprise travel of the gondola 40 along the track 20 or movement of the track 30 with respect to the gondola 40.

Although the illustrated embodiments show tracks 20 that are disposed generally in a plane (e.g. a vertical plane), it is possible for tracks to deviate at least in part from such a plane, to add extra interest to the ride.

Embodiments of the invention may comprise tracks such as 20 that are rotated through full revolutions—that is, 360° and more. Alternatively, tracks such as 20 may rotate through less than a full revolution—e.g. rotating alternately in opposite directions.

The supports such as 10 may be mounted for rotation of the ride 1 about a generally upright or vertical axis, to add another element of movement to the ride.

Two rides such as 1 may be mounted in mutual juxtaposition (e.g. parallel to one another) such that riders on one of the rides pass close by the riders on the other ride. Two such rides may rotate out of phase by a predetermined or variable amount or in opposite directions.

It will be appreciated that the illustrated embodiments of the invention, shown and described by way of example, may be much less expensive to construct and require a much smaller footprint than conventional roller coaster rides, whilst also providing new and various ride experiences. The various components of the rides may readily be constructed from sections that may be assembled, disassembled and transported. Consequently, there may be provided amusement rides that afford a ride experience of the roller coaster type, and more, but are well-suited as mobile rides that can be moved readily from one fairground site to another, as with travelling fairs.

Accordingly, the invention extends to embodiments of the invention that include road or rail trucks and trailers upon which the amusement rides are carried when disassembled. Such trucks and trailers may afford bases for the rides when assembled—typically being provided with legs that extend laterally from the truck or trailer in the manner of outriggers and engage the ground to provide stability.

In this specification, the verb "comprise" has its normal dictionary meaning, to denote non-exclusive inclusion. That is, use of the word "comprise" (or any of its derivatives) to include one feature or more, does not exclude the possibility of also including further features. The word "preferable" (or any of its derivatives) indicates one feature or more that is preferred but not essential.

All or any of the features disclosed in this specification (including any accompanying claims, abstract and drawings), and/or all or any of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An amusement ride comprising:

a support;

a track that is mounted on the support and defines a continuous path of travel of a carriage, the path having a vertical component of direction; and a carriage mounted and retained on the track for travel along the track;

wherein:

the track is mounted on the support for rotational movement about an axis to cause relative movement between the carriage and the track, at least partly under the force of gravity;

the track is at least partly of sinuous form such that the path includes successive downhill sections, the steepness of which varies due to rotation of the track and the sinuous form of the track;

a speed of the carriage along the track can vary in dependence upon said steepness;

the track is long relative to the carriage;

the track can perform complete rotations about said axis;

in use, the travel of the carriage extends above said axis; and said path is substantially upright.

2. An amusement ride according to claim 1, wherein the track is an endless track.

3. An amusement ride according to claim 1, wherein said axis is substantially horizontal.

4. An amusement ride according to claim 1, further comprising a powered adjusting device that adjusts an angle of said axis to the horizontal and thus an angle of said path to the vertical.

5. An amusement ride according to claim 1, wherein the carriage or the track includes a brake that can cause braking of the travel of the carriage with respect to the track.

6. An amusement ride according to claim 1, wherein the carriage or the track includes a drive device that can cause acceleration of the travel of the carriage with respect to the track.

7. An amusement ride according to claim 1, wherein said path is a fixed path.

8. An amusement ride according to claim 1, further comprising a prime mover arranged to impart said rotational movement to the track.

9. An amusement ride according to claim 1, further comprising a controller arranged to control said rotational movement of the track.

10. An amusement ride according to claim 9, wherein said controller is arranged to control acceleration and/or deceleration of the carriage with respect to the track.

11. An amusement ride according to claim 1, wherein the track has inner and outer surfaces that run substantially parallel to one another.

12. An amusement ride according to claim 1, wherein the carriage is positioned at an outer surface of the track.

13. An amusement ride according to claim 1, wherein a radius of the track, measured as the distance from the track to the axis of rotation, varies along a length of the track.

14. An amusement ride according to claim 13, wherein the track has a maximum radius and a minimum radius and the maximum radius is at least 2 times the minimum radius.

15. An amusement ride according to claim 1, wherein an overall length of the track is at least 20 times a length of the carriage.

16. An amusement ride according to claim 1, wherein the track has changes in gradient that are gradual, relative to a length of the carriage.

17. An amusement ride according to claim 1, wherein the carriage can travel upwardly to a top of the track and over the top of the track.

18. An amusement ride according to claim 1, wherein a direction of rotation of the track is reversible.

19. An amusement ride according to claim 1, further comprising a plurality of said carriages mounted on the track.

20. A method of operating an amusement ride, the method comprising:

mounting and retaining a carriage on a track for travel along the track, the track being mounted on a support and defining a continuous path of travel of the carriage, the path having a vertical component of direction; and rotating the track about an axis to cause relative movement between the carriage and the track, at least partly under the force of gravity;

wherein:

the track is at least partly of sinuous form such that it presents successive downhill sections, the steepness of which varies due to rotation of the track and the sinuous form of the track;

a speed of the carriage along the track varies in dependence upon said steepness;

the track is long relative to the carriage;

the track is able to perform complete rotations about said axis;

the travel of the carriage extends above said axis; and said path is substantially upright.

21. An amusement ride comprising:

a support;

a track that is mounted on the support and defines a continuous path of travel of a carriage, the path having a vertical component of direction; and a carriage mounted and retained on the track for travel along the track;

wherein:

the track is mounted on the support for rotational movement about an axis to cause relative movement between the carriage and the track, at least partly under the force of gravity;

the track is at least partly of sinuous form such that the path includes successive downhill sections, the steepness of which varies due to rotation of the track and the sinuous form of the track;

a speed of the carriage along the track can vary in dependence upon said steepness;

the track is long relative to the carriage;

the track can perform complete rotations about said axis;

in use, the travel of the carriage extends above said axis;

the rider further comprises a controller arranged to control said rotational movement of the track;

an angle of said axis relative to the horizontal can be changed; and said controller is further arranged to control the angle of said axis to the horizontal and thus an angle of said path to the vertical.

22. An amusement ride according to claim 21, wherein the track is an endless track.

23. An amusement ride according to claim 21, wherein the carriage or the track includes a brake that can cause braking of the travel of the carriage with respect to the track.

24. An amusement ride according to claim 21, wherein the carriage or the track includes a drive device that can cause acceleration of the travel of the carriage with respect to the track.

25. An amusement ride according to claim 21, wherein said path is a fixed path.

26. An amusement ride according to claim 21, further comprising a prime mover arranged to impart said rotational movement to the track.

27. An amusement ride according to claim 21, wherein said controller is arranged to control acceleration and/or deceleration of the carriage with respect to the track.

28. An amusement ride according to claim 21, wherein the carriage is positioned at an outer surface of the track.

29. An amusement ride according to claim 21, wherein a radius of the track, measured as the distance from the track to the axis of rotation, varies along a length of the track.

30. An amusement ride according to claim 29, wherein the track has a maximum radius and a minimum radius and the maximum radius is at least 2 times the minimum radius.

31. An amusement ride according to claim 21, wherein an overall length of the track is at least 20 times a length of the carriage.

32. An amusement ride according to claim 21, wherein the track has changes in gradient that are gradual, relative to a length of the carriage.

33. An amusement ride according to claim 21, wherein the carriage can travel upwardly to a top of the track.

34. An amusement ride according to claim 21, wherein the carriage can travel upwardly to a top of the track and over the top of the track.

35. An amusement ride according to claim 21, wherein a direction of rotation of the track is reversible.

36. An amusement ride according to claim 21, further comprising a plurality of said carriages mounted on the track.

37. A method of operating an amusement ride, the method comprising:

mounting and retaining a carriage on a track for travel along the track, the track being mounted on a support and defining a continuous path of travel of the carriage, the path having a vertical component of direction; and rotating the track about an axis to cause relative movement between the carriage and the track, at least partly under the force of gravity;

wherein:

the track is at least partly of sinuous form such that it presents successive downhill sections, the steepness of which varies due to rotation of the track and the sinuous form of the track;

a speed of the carriage along the track varies in dependence upon said steepness;

the track is long relative to the carriage;

the track is able to perform complete rotations about said axis;

the travel of the carriage extends above said axis;

the rider further comprises a controller arranged to control said rotational movement of the track;

an angle of said axis relative to the horizontal can be changed; and said controller is further arranged to control the angle of said axis to the horizontal and thus an angle of said path to the vertical.

38. An amusement ride comprising:

a support;

a track that is mounted on the support and defines a continuous path of travel of a carriage, the path having a vertical component of direction; and a carriage mounted and retained on the track for travel along the track;

wherein:

the track is mounted on the support for rotational movement about an axis to cause relative movement between the carriage and the track, at least partly under the force of gravity;

the track is at least partly of sinuous form such that the path includes successive downhill sections, the steepness of which varies due to rotation of the track and the sinuous form of the track;

a speed of the carriage along the track can vary in dependence upon said steepness;

the track is long relative to the carriage;

the track can perform complete rotations about said axis;

in use, the travel of the carriage extends above said axis; and the carriage is positioned at an outer surface of the track.

39. An amusement ride according to claim 38, wherein the track is an endless track.

40. An amusement ride according to claim 38, wherein said axis is substantially horizontal.

41. An amusement ride according to claim 38, further comprising a powered adjusting device that adjusts an angle of said axis to the horizontal and thus an angle of said path to the vertical.

42. An amusement ride according to claim 38, wherein the carriage or the track includes a brake that can cause braking of the travel of the carriage with respect to the track.

43. An amusement ride according to claim 38, wherein the carriage or the track includes a drive device that can cause acceleration of the travel of the carriage with respect to the track.

44. An amusement ride according to claim 38, wherein said path is a fixed path.

45. An amusement ride according to claim 38, further comprising a prime mover arranged to impart said rotational movement to the track.

46. An amusement ride according to claim 38, further comprising a controller arranged to control said rotational movement of the track.

47. An amusement ride according to claim 46, wherein said controller is arranged to control acceleration and/or deceleration of the carriage with respect to the track.

48. An amusement ride according to claim 38, wherein a radius of the track, measured as the distance from the track to the axis of rotation, varies along a length of the track.

49. An amusement ride according to claim 48, wherein the track has a maximum radius and a minimum radius and the maximum radius is at least 2 times the minimum radius.

50. An amusement ride according to claim 38, wherein an overall length of the track is at least 20 times a length of the carriage.

51. An amusement ride according to claim 38, wherein the track has changes in gradient that are gradual, relative to a length of the carriage.

52. An amusement ride according to claim 38, wherein the carriage can travel upwardly to at least a level of the axis of rotation.

53. An amusement ride according to claim 38, wherein the carriage can travel upwardly above the axis of rotation.

54. An amusement ride according to claim 38, wherein the carriage can travel upwardly to a top of the track.

55. An amusement ride according to claim 38, wherein the carriage can travel upwardly to a top of the track and over the top of the track.

56. An amusement ride according to claim 38, wherein a direction of rotation of the track is reversible.

57. An amusement ride according to claim 38, further comprising a plurality of said carriages mounted on the track.

58. A method of operating an amusement ride, the method comprising:

mounting and retaining a carriage on a track for travel along the track, the track being mounted on a support and defining a continuous path of travel of the carriage, the path having a vertical component of direction; and rotating the track about an axis to cause relative movement between the carriage and the track, at least partly under the force of gravity;

wherein:

the track is at least partly of sinuous form such that it presents successive downhill sections, the steepness of which varies due to rotation of the track and the sinuous form of the track;

a speed of the carriage along the track varies in dependence upon said steepness;

the track is long relative to the carriage;

the track is able to perform complete rotations about said axis;

the travel of the carriage extends above said axis; and the carriage is positioned at an outer surface of the track.

* * * * *